United States Patent [19]

Reiling et al.

[11] Patent Number: 4,769,955

[45] Date of Patent: Sep. 13, 1988

[54] FIXTURE FOR HOLDING A HOLE-CUTTING TOOL HAVING CUTTING EDGES TO BE GROUND

[76] Inventors: Reinhold Reiling; Karl Reiling, both of Remchinger Strasse 4, D-7535 Königsbach-Stein, Fed. Rep. of Germany

[21] Appl. No.: 72,728

[22] Filed: Jul. 13, 1987

[30] Foreign Application Priority Data

Aug. 9, 1986 [DE] Fed. Rep. of Germany ..... 3627012

[51] Int. Cl.[4] ..... B24B 3/26

[52] U.S. Cl. ..... 51/219 R; 51/218 A

[58] Field of Search ..... 51/219 R, 219 PC, 218 R, 51/217 R, 217 P, 217 A, 124 R, 218 A, 218 P

[56] References Cited

U.S. PATENT DOCUMENTS

| | | | |
|---|---|---|---|
| 3,521,405 | 7/1970 | Mackey, Jr. et al. | 51/124 R |
| 4,270,315 | 6/1981 | Reiling et al. | 51/219 R |
| 4,547,999 | 10/1985 | Reiling et al. | 51/219 R |
| 4,646,474 | 3/1987 | Chen | 51/219 R |
| 4,716,688 | 1/1988 | Reiling et al. | 51/219 R |

*Primary Examiner*—Frederick R. Schmidt

*Assistant Examiner*—Robert A. Rose

*Attorney, Agent, or Firm*—Balogh, Osann, Kramer, Dvorak, Genova & Traub

[57] ABSTRACT

This invention relates to a fixture for holding twist drills having cutting edges to be ground. A stand is mounted on a base plate, which is displaceable and/or rotatable. The stand carries a bracket, which carries gripping unit for gripping the drill to be ground. The gripping unit comprises two gripping jaws and is adapted to be detachably mounted on the bracket in two predetermined positions. The bracket is formed with angle-section track grooves for guiding the gripping unit. Each gripping jaw comprises two outer edges, which extend along said track grooves, and adjacent to said outer edges is formed with two angle-section guides, which are adapted to interengage with said track grooves and to be slidably guided by said track grooves. The bracket is provided with a thrust screw for clamping the angle-section guides in the track grooves. A grinding apparatus is also disclosed, which comprises a grinding unit carrying a grinding wheel and in which the base plate is movable relative to the grinding unit.

19 Claims, 3 Drawing Sheets

1
2
3
4
5
6
6a
7
7a
8a
8b
11
12
13
14
15
16
17
18
19
21
22
23
23a
24
25
25a
A
A'
B
C
D
E
F
G
H
J
K

FIXTURE FOR HOLDING A HOLE-CUTTING TOOL HAVING CUTTING EDGES TO BE GROUND

BACKGROUND OF THE INVENTION

1. Field of the Invention

This invention relates to a fixture for holding a hole-cutting tool having cutting edges to be ground, which fixture comprises a displaceable and/or rotatable baseplate, a stand, which is secured to said baseplate, a bracket, which is carried by said stand, and a gripping unit, which comprises two gripping jaws, which are adapted to grip said tool and are detachably mounted on said bracket in one predetermined position and adapted to be mounted thereon in at least one additional predetermined position. The fixture is intended for use with a grinding unit, which comprises a grinding wheel for grinding a tool when it is gripped by said jaws.

2. Description of the Prior Art

Fixtures for holding twist drills to be ground have been disclosed, e.g., in U.S. Pat. No. 4,270,315 (and the corresponding German Patent Specification 29 15 601) and in U.S. Pat. No. 4,547,999 (and the corresponding German Patent Specification No. 31 46 664). Each of said known fixtures comprises a gripping unit including two prismatic gripping jaws for gripping the drill to be ground. Said gripping unit is pivoted on a horizontal pivot pin, which is adapted to be detachably mounted in different positions on a stand disposed adjacent to the grinding unit. When the twist drill is to be reground by the end face or the peripheral surface of the grinding wheel the gripping unit is to be pivotally urged about the pivot pin against the grinding wheel by hand.

German Patent Specification No. 35 17 034 (published after the Convention date of the present application) and the corresponding U.S. patent application Ser. No. 855,092 now U.S. Pat. No. 4,716,688 disclose such a fixture in which the gripping unit is mounted on an upright mounting pin, which is mounted on the base of an angle bracket, which has a back structure that is pivoted to the stand on a horizontal pivotal axis, which is at right angles to the axis of the mounting pin. That design ensures that the gripping unit will be precisely held in position and need no longer be urged by hand so that even twist drills which are relatively large in diameter can be reground in the workshop in which they have been used. But in that known fixture the back structure has a tapered surface, which is in backlash-free contact with the gripping unit mounted on the mounting pin so that the gripping unit is clamped in position and can be detached by hand only with difficulty. Besides, the twist drill to be ground cannot easily be adjusted.

SUMMARY OF THE INVENTION

It is a first object of the invention to provide for grinding cutting edges of hole-cutting tools an apparatus which has industrial utility and in which the gripping unit can easily be detached without a need for an implement and in which the tool to be ground can be adjusted by different adjusting means without a need for ungripping the tool so that the handling will be simplified and improved.

It is a second object of the invention to provide a fixture which is of the kind described first hereinbefore and permits of a coarse and fine adjustment of the tool to be ground.

In a fixture which is of the kind described first hereinbefore one first object is accomplished in that said bracket has a mounting surface which is remote from and faces away from said stand and is formed with two angle-section track grooves, each of said gripping jaws has a forward end portion formed with two laterally spaced apart, parallel angle-section guides, which are adapted to be slidably mounted in said track grooves, and the bracket carries a thrust screw for detachably clamping said gripping unit in said bracket.

In a preferred embodiment the bracket comprises a back structure, which is pivoted to the stand on an axis and can be fixed in position, and a guiding member, which is pivoted to said back structure on a second pivotal axis which is parallel to said first pivotal axis, and the guiding member can be fixed in position relative to said back structure. In such an arrangement the guiding member for guiding the detachable mounted gripping unit is rotatable about said second pivotal axis, which is vertical, so that the gripping unit can be pivotally moved in a lateral direction without a need for a rotation of the stand.

DETAILED DESCRIPTION OF THE PREFERRED EMBODIMENT

Figure 1:
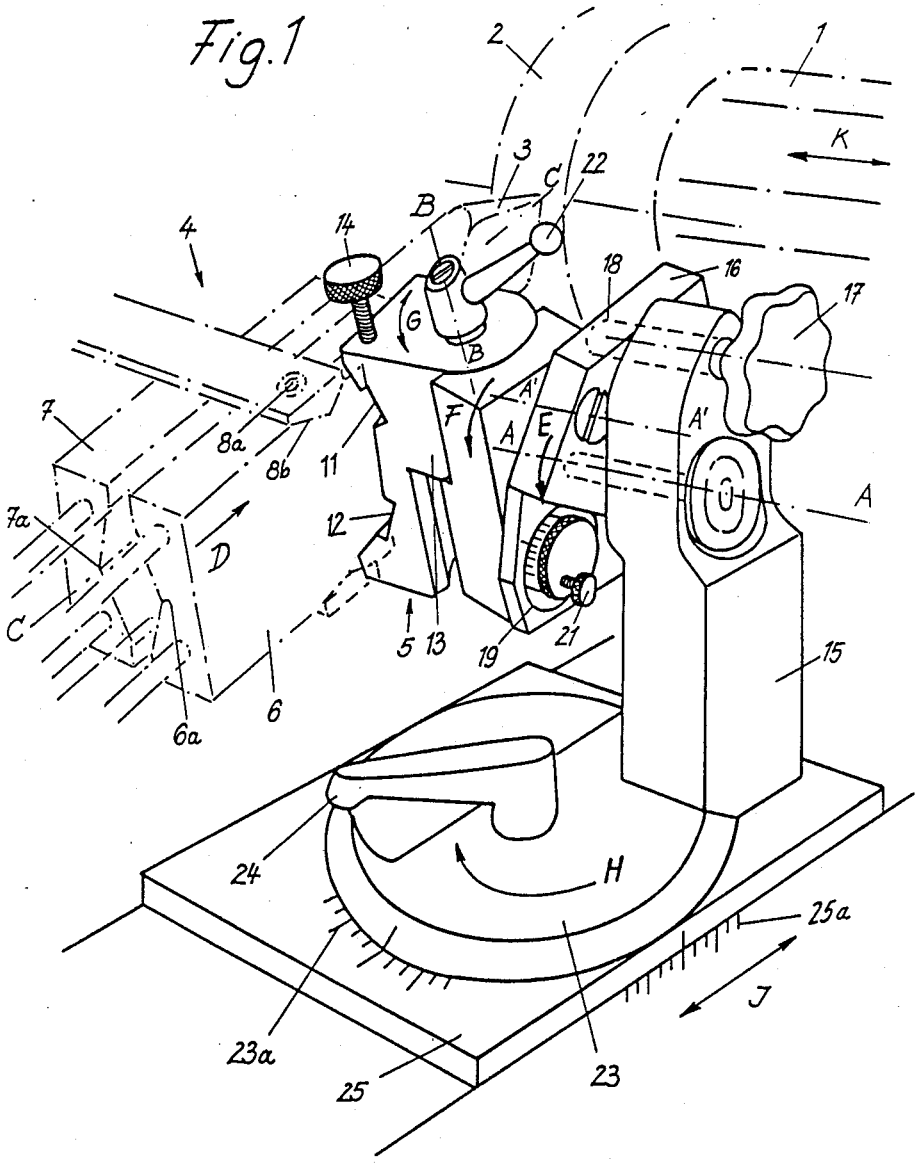
FIG. 1 is a perspective view showing an apparatus for regrinding the cutting edges of twist drills gripped in a gripping unit.

Further details of the invention will become apparent from the following description of an illustrative embodiment shown on the drawing.

The apparatus shown on the drawing serves to grind the cutting edges of twist drills and comprises a fixture for gripping said twist drill and a grinding unit 1 provided with a grinding wheel 2. The twist drill 3 is gripped in said fixture by a gripping unit 4, which is detachably mounted in a first predetermined position and is adapted to be detachably mounted in a second predetermined position. Such fixtures are shown in U.S. Pat. Nos. 4,270,315 and 4,547,999. The gripping unit 4 comprises two prismatic gripping jaws 6 and 7, each of which is formed on its inside surface facing the other gripping jaw with V-shaped groove 6*a* or 7*a* for engaging the twist drill 3. The gripping unit 4 also comprises a U-shaped retaining member 8, which embraces the two gripping jaws. One gripping jaw 6 is screw-connected to the free ends of the legs of the retaining member 8 by screw means 8*a*. The other jaw 7 is formed on opposite sides with V-shaped grooves 8*b*, which slidably receive complementary intermediate portions of the legs of the retaining member 8 so that the jaw 7 is movable toward the jaw 6 along the legs by means of a clamp screw 9, which is screwed through the web of the retaining member 8 and bears on the gripping jaw 7. Each gripping jaw has a forward end portion and is formed on that end portion on that surface which is remote from the other gripping jaw with two angle-section guides 10, which are disposed near opposite side edges of said surface and extend along the axis of the gripping unit 4 and conform to two transversely spaced apart, parallel angle-section track grooves 11, 12 formed in the adjacent mounting surface of the bracket 5 so that the gripping unit can be detachably mounted on the bracket 5 in a second predetermined position after a rotation through 180° about the axis C—C of the twist drill 3 (FIG. 1). The gripping unit 4 is also provided with two rear jaw members **6*b* and 7*b*, which are mounted in respective ones of the gripping jaws 6 and 7 and are slidably extensible therefrom in their longitudinal direction and are adapted to be fixed in position relative to the gripping jaws. Said rear jaw members 6*b*, 7*b* are adapted to assist the holding of particularly long twist drills 3 in the manner shown in FIG. 2**.

Figure 2:
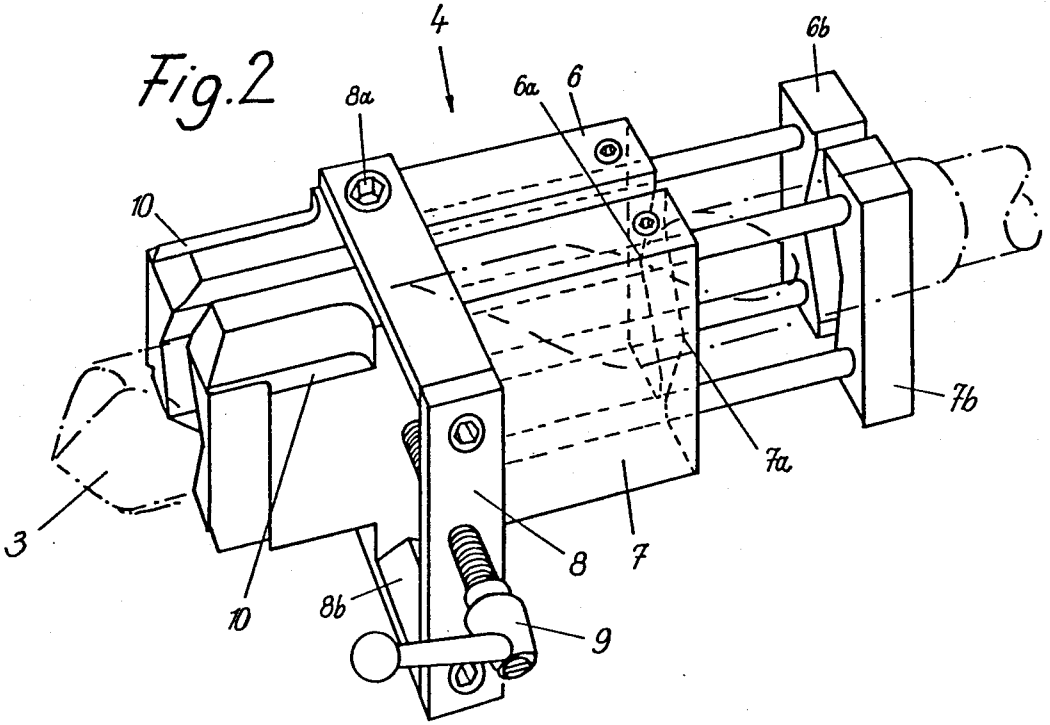
FIG. 2 is a perspective view showing a gripping unit and a twist drill which is gripped therein and which appears shorter owing to the perspective view.

It is apparent from FIG. 2 that each of the gripping jaws 6, 7 is provided in that surface which is remote from the other gripping jaw with the two angle-section guides 10, which extend along the outer edges of said jaw. One of the jaws 6 and 7 has been slidably inserted in the direction D into the guiding member 13 of the bracket 5 so that the angle-section guides 10 of said one jaw 6 interfit with and are slidable along the track grooves 11, 12 of the guiding member 13. The gripping unit 4 is fixed in position relative to the bracket 5 in that the thrust screw 14 has been tightened to clamp the gripping jaw 6 in position as shown in FIG. 1. When the gripping jaw 6 has been released and removed from the bracket 5, the gripping unit 4 can be rotated through 180° about the axis C—C of the twist drill 3 to be reground and can then be mounted in the bracket 5 in a second predetermined position in which the angle-section guiding portions 10 of the other gripping jaw 7 are inserted into the track grooves 11, 12. Between the track grooves 11 and 12, the bracket 5 carries a stop pin for limiting the movement of the gripping unit 4 along the track grooves 11, 12.

Figure 3:
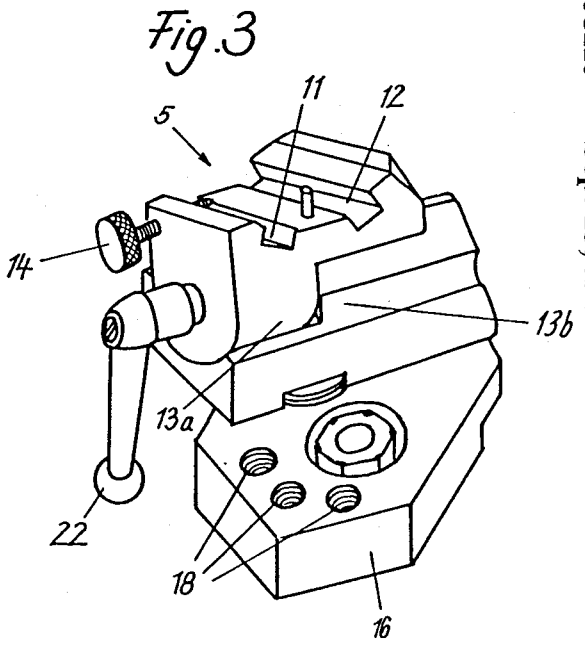
FIG. 3 is a fragmentary perspective view showing the bracket and the back structure.
Figure 4:
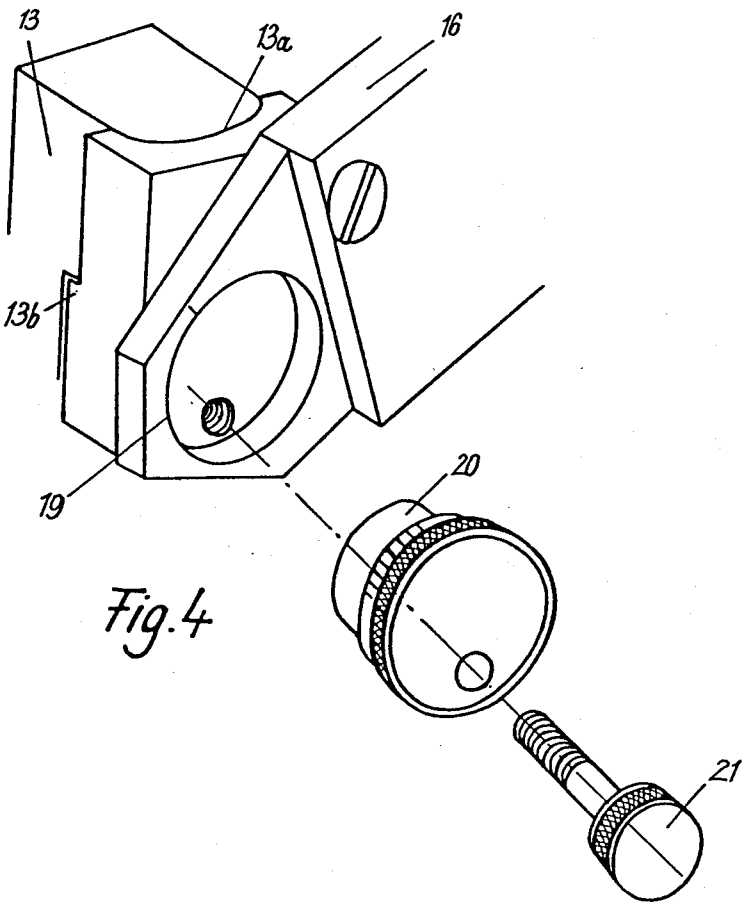
FIG. 4 is a perspective view showing eccentric means for adjusting the guiding member of the bracket relative to the back structure.

The guiding member 13 of the bracket 5 is mounted on the stand 15 for a pivotal movement in the direction indicated by the arrow E about a first horizontal axis A—A and in the direction indicated by the arrow F about a second horizontal axis A'—A', which is parallel to the axis A—A. The guiding member 13 can be fixed in position about each of the axes A—A and A'—A'. The back structure 16 of the bracket 5 is mounted on the stand 15 by means of a pin 17, which is insertable into any of an arcuate series of holes 18 about the axis A—A so that the back structure 16 is adjustable about said axis A—A in steps, as is illustrated in FIG. 3. An infinite pivotal adjustment about the axis A'—A' is imparted to the guiding member 13 by means of an eccentric disc 20, which is rotatable in an oval hole 19 and adapted to be fixed by a tightening screw 21, as is shown in FIG. 4.

The guiding member 13 of the bracket 5 is also pivotally movable in a direction indicated by the arrow G about an axis B—B, which is at right angles to the axes A—A and A'—A'. The horizontal axes A—A crosses the axis of the twist drill and is spaced therefrom. For this purpose the guiding member 13 has a pert-cylindrical rib **13*a* and the bracket 5 comprises a bearing member 13*a*, which is pivoted to the back structure on the axis A'—A' and is formed with a concave groove, which pivotally receives the rib. The guiding member 13 and the bearing member 13*b* are formed with interfitting steps for supporting the guiding member 13 on the bearing member 13*b*. The guiding member 13 carries a tightening lever for locking the rib 13 in position in the bearing member 13*b***.

The stand 15 is mounted on a carriage 25 by means of a turntable 23 for rotation in the direction indicated by the arrow and the turntable 23 is adapted to be held in position by a tightening lever 24. The carriage 25 is movable in the direction J toward the peripheral surface of the grinding wheel 2 at right angles to the axis of said grinding wheel. The grinding wheel 2 is rotatably mounted on the grinding unit 1, which is movable into engagement with the twist drill 3 in the direction indicated by the arrow K. As is shown in FIG. 1, scales **23*a* and 25*a* for indicating the angular position of the turntable 23 and the position of the carriage 25 along its track may be associated with the turntable 23 and the carriage 25**, respectively.

We claim:

1. In a fixture for holding an elongate hole-cutting tool having a longitudinal axis and a cutting tip with two diametrically opposite cutting edges to be ground by a grinding wheel, which fixture comprises a stand;

a bracket, which is pivoted to said stand;

a gripping unit, which has an axis and is detachably mounted on said bracket in one predetermined position for grinding one of said cutting edges, and adapted to be detachably mounted in said bracket in a second predetermined position after a rotation through 180° about said axis of said gripping unit, for grinding the other of said cutting edges, which gripping unit comprises first and second gripping jaws for gripping said tool so that its longitudinal axis coincides with said axis of said gripping unit and said cutting tip protrudes from said gripping unit, and jaw-fixing means provided on said bracket and arranged to engage said first and second gripping unit in said first and second predetermined positions, respectively, wherein said bracket has a first mounting surface facing said gripping unit, the improvement residing in that each of said gripping jaws has a second mounting surface, which faces away from the other gripping jaw and is formed with two angle-section guides, which extend along and are spaced apart transversely to said axis of said gripping unit, and said jaw-fixing means comprise two angle-section track grooves, which are formed in said first mounting surface and extend parallel to said axis of said gripping unit and are adapted to receive and to guide along said track grooves said angle-section guides of each of said jaws, and a thrust screw, which is mounted on said bracket and operable to clamp said guides of each of said jaws in said grooves.

2. The improvement set forth in claim 1, wherein each of said jaws has two outer edge portions which are parallel to said axis of said gripping unit and extend on opposite sides of said second mounting surface and are formed with said angle-section guides.

3. The improvement set forth in claim 1, which comprises first pivotal mounting means for pivoting said first mounting surface on a first horizontal axis, which crosses said axis of said gripping unit, first fixing means for fixing said bracket in position about said first axis, additional pivotal mounting means for pivoting said mounting surface on an additional axis, which is at right angles to said first horizontal axis, and additional fixing means for fixing said first mounting surface in position about said additional axis.

4. The improvement set forth in claim 3, wherein said first fixing means comprise an arcuate series of holes about said first horizontal axis and a pin which is adapted to be inserted into any of said holes so that said first mounting surface is adjustable in steps about said first horizontal axis.

5. The improvement set forth in claim 3, wherein said second pivotal mounting means comprise an oval hole and eccentric disc, which is rotatably mounted in said oval hole, and second fixing means are provided for fixing said eccentric disc in position in said oval hole.

6. The improvement set forth in claim 3, wherein said bracket comprises a back structure, which is pivoted to said stand about said first horizontal axis and is adapted to be fixed about said first horizontal axis by said first fixing means, said bracket also comprises a bearing member and a guiding member, which is formed with said first mounting surface, said bearing member is pivoted to said back structure by second pivotal mounting means about a second horizontal axis, which is parallel to said first horizontal axis, second fixing means are provided for fixing said bearing member to said back structure in position about said second axis, said guiding member is hinged to said bearing member about said additional axis, which is vertical, and said additional fixing means are adapted to fix said guiding member to said bearing member in position about said additional axis.

7. The improvement set forth in claim 6, wherein said first fixing means comprise an arcuate series of holes about said first horizontal axis and a pin which is adapted to be inserted into said holes so that said back structure is adjustable in steps about said first horizontal axis.

8. The improvement set forth in claim 6, wherein said first fixing means comprise an arcuate series of holes about said first horizontal axis and a pin which is adapted to be inserted into said holes so that said back structure is adjustable in steps about said first horizontal axis, said second pivotal mounting means comprise an oval hole and an eccentric disc, which is rotatably mounted in said oval hole, and said second fixing means are adapted to fix said eccentric disc in position in said oval hole.

9. The improvement set forth in claim 1, wherein said bracket comprises a bearing member, which is carried by said stand, a guiding member, which is formed with said first mounting surface and movably mounted on said bearing member, and means for fixing said guiding member in position to said bearing member.

10. The improvement set forth in claim 9, wherein one of said members of said bracket comprises a concave groove and the other of said members of said bracket comprises a convex rib which interfits with said concave groove.

11. The improvement set forth in claim 9, wherein said bearing and mounting members are formed with interfitting steps for movably supporting said guiding member on said bearing member.

12. The improvement set forth in claim 1, wherein each of said gripping jaws has a forward end portion and a rear end opposite to said forward end portion, each of said gripping jaws is formed with said first mounting surface on said forward end portion, each of said gripping jaws carries at its rear end a rear jaw member, which is extensible from said gripping jaw along said axis of said gripping unit, and fixing means are provided for fixing said rear jaw members in position relative to said gripping jaws.

13. The improvement set forth in claim 1, wherein each of said gripping jaws consists of a prism having two mutually opposite generally parallel surfaces on opposite sides of said second mounting surface, said gripping unit comprises a U-shaped retaining member, which comprises two parallel legs extending on opposite sides of said gripping jaws across said axis of said gripping unit, and a web connecting said legs at one end thereof, each of said generally parallel surfaces of one of said legs is formed with a guiding groove, which is parallel to said legs, each of said legs has a free end portion that is opposite to said web and secured to one of said jaws at one of said parallel surfaces thereof the other of said gripping jaws is formed in each of said parallel surfaces thereof with a guiding groove that is parallel to said legs, each of said legs has an intermediate portion, which fits one of said guiding grooves and is slidable therein along said leg, and screw means are mounted on said web and adapted to cooperate with the other of said gripping jaws to force the same toward said one gripping jaw.

14. In a fixture for holding an elongate hole-cutting tool having a longitudinal axis and a cutting tip with two diametrically opposite cutting edges to be ground by a grinding wheel, which fixture comprises a stand;

a bracket, which is pivoted to said stand;

a gripping unit, which has an axis and is detachably mounted on said bracket in one predetermined position for grinding one of said cutting edges, and adapted to be detachably mounted in said bracket in a second predetermined position after a rotation through 180° about said axis of said gripping unit, for grinding the other of said cutting edges, which gripping unit comprises first and second gripping jaws for gripping said tool so that its longitudinal axis coincides with said axis of said gripping unit and said cutting tip protrudes from said gripping unit, and jaw-fixing means provided on said bracket and arranged to engage said first and second gripping jaws when said gripping unit is in said first and second predetermined positions, respectively, wherein said bracket has a first mounting surface facing said gripping unit, the improvement residing in that each of said gripping jaws has a second mounting surface, which faces away from the other gripping jaw and is engageable with said first mounting surface the improvement residing in that said fixture comprises first pivotal mounting means for pivoting said first mounting surface on a first horizontal axis, which crosses said axis of said gripping unit, first fixing means for fixing said bracket in position about said first axis, additional pivotal mounting means for pivoting said mounting surface on an additional axis, which is at right angles to said first horizontal axis, and additional fixing means for fixing said first mounting surface in position about said additional axis, and said fixture further comprises second pivotal mounting means for pivoting said mounting surface on a second horizontal axis, which is parallel to and spaced from said first horizontal axis, and second fixing means for fixing said first mounting surface in position about said second horizontal axis, wherein said first fixing means comprise an arcuate series of holes about said first horizontal axis and a pin which is adapted to be inserted into any of said holes so that said first mounting surface is adjustable in steps about said first horizontal axis, and said second pivotal mounting means comprise an oval hole and an eccentric disc which is rotatably mounted in said oval hole.

15. The improvement set forth in claim 14, wherein said bracket comprises a back structure, which is pivoted to said stand about said first horizontal axis and is adapted to be fixed about said first horizontal axis by said first fixing means, said bracket also comprises a bearing member and a guiding member, which is formed with said first mounting surface, said bearing member is pivoted to said back structure by said second pivotal mounting means, said guiding member is hinged to said bearing member about said additional axis, which is vertical, and said additional fixing means are adapted to fix said guiding member to said bearing member in position about said additional axis, each of said legs has an intermediate portion, which fits one of said guiding grooves and is slidable therein along said leg, and screw means are mounted on said web and adapted to cooperate with the other of said gripping jaws to force the same toward said one gripping jaw.

16. Apparatus for grinding an elongate hole-cutting tool having a longitudinal axis and a cutting tip with two diametrically opposite cutting edges to be ground, which apparatus comprises a grinding unit comprising a rotatably mounted grinding wheel for grinding said tool at said cutting edges, and a fixture for holding said tool with said cutting edges in contact with said grinding wheel, which fixture comprises a stand, which is mounted to be movable relative to said grinding unit, a bracket, which is pivoted to said stand;

a gripping unit, which has an axis and is detachably mounted on said bracket in one predetermined position for grinding one of said cutting edges, and adapted to be detachably mounted in said bracket in a second predetermined position after a rotation through 180° about said axis of said gripping unit, for grinding the other of said cutting edges, which gripping unit comprises first and second gripping jaws for gripping said tool so that its longitudinal axis coincides with said axis of said gripping unit and said cutting tip protrudes from said gripping unit, and jaw-fixing means provided on said bracket and arranged to engage said first and second gripping jaws when said gripping unit is in said first and second predetermined positions, respectively, wherein said bracket has a first mounting surface facing said gripping unit, the improvement residing in that each of said gripping jaws has a second mounting surface, which faces away from the other gripping jaw and is formed with two angle-section guides, which extend along and are spaced apart transversely to said axis of said gripping unit, and said jaw-fixing means comprise two angle-section track grooves, which are formed in said first mounting surface and extend parallel to said axis of said gripping unit and are adapted to receive and to guide along said track grooves said angle-section guides of each of said jaws, and a thrust screw, which is mounted on said bracket and operable to clamp said guides of each of said jaws in said grooves.

17. The improvement set forth in claim 16, as applied to apparatus comprising a rotatably mounted baseplate, which carries said stand.

18. The improvement set forth in claim 16 as applied to apparatus comprising a slidably mounted baseplate which carries said stand.

19. The improvement set forth in claim 15, as applied to apparatus in which said stand is rotatably mounted on a carriage, which is displaceable relative to said gripping unit.

* * * * *